United States Patent [19]

Prohaska et al.

[11] 4,220,484

[45] Sep. 2, 1980

[54] PROCESS FOR THE PREPARATION OF AN ALUMINUM BASE FOR OFFSET PRINTING PLATES AND PRODUCT

[75] Inventors: Helmut Prohaska, St. Poelten; Franz Reiterer, Vienna; Klaus Bretthauer, Ober-Grafendorf; Helmut Kloss, St. Georgener, all of Austria

[73] Assignee: Folienwalzwerk Brueder Teich Aktiengesellschaft, Muehlhofen, Austria

[21] Appl. No.: 953,423

[22] Filed: Oct. 23, 1978

Related U.S. Application Data

[63] Continuation-in-part of Ser. No. 926,967, Jul. 24, 1978, abandoned.

[30] Foreign Application Priority Data

Jul. 25, 1977 [AT] Austria ..... 5380/77

[51] Int. Cl.[2] ..... C23F 7/06

[52] U.S. Cl. ..... 148/6.3; 148/6.27; 148/11.5 A; 148/31.5; 430/275; 72/365; 430/302

[58] Field of Search ..... 72/365, 366; 29/DIG. 2, 29/32, 426, 427; 228/158, 264, 117, 196, 116, 197, 191, 199, 155; 148/11.5 A, 12.7 A, 6.3; 96/33

[56] References Cited

U.S. PATENT DOCUMENTS

| | | | |
|---|---|---|---|
| 2,882,153 | 4/1959 | Cohn | 96/86 R |
| 2,882,154 | 4/1959 | Cohn | 96/86 R |
| 3,577,920 | 5/1971 | London et al. | 228/199 |
| 3,891,516 | 6/1975 | Chu | 96/33 |

*Primary Examiner*—Ralph S. Kendall

*Attorney, Agent, or Firm*—Hammond & Littell, Weissenberger and Muserlian

[57] ABSTRACT

A process for the preparation of an improved base for offset printing plates comprising superimposing together two prerolled aluminum ribbons with an individual thickness of 0.12 to 0.5 mm, rolling the said superimposed ribbons to an individual ribbon thickness of 0.08 to 0.22 mm whereby the mutual contact surfaces have an uniform surface roughness, separating the two ribbons and forming a stable aluminum oxide layer on the uniformly roughened surfaces which have improved properties when used as a base for offset printing plates.

8 Claims, No Drawings

PROCESS FOR THE PREPARATION OF AN ALUMINUM BASE FOR OFFSET PRINTING PLATES AND PRODUCT

PRIOR APPLICATION

This application is a continuation-in-part of our copending, commonly assigned U.S. patent application Ser. No. 926,867 filed July 24, 1978, now abandoned.

STATE OF THE ART

Bases for offset printing plates are known in which a high grade aluminum sheet or ribbon is provided on one side thereof with an optionally uniform surface roughness. One well known method for the manufacture of such a sheet comprises rolling aluminum to a smooth finish with a thickness of 0.08 to 0.22 mm, degreasing the aluminum band and roughing one surface thereof with brushing machines. However, roughness diagrams of the surfaces obtained by the process show that there is little uniformity in the roughness. Practically, singularly pronounced roughness depths which show a large deviation from the average peak to valley height with a magnitude of 0.003 to 0.004 mm can't be avoided and another disadvantage is that the roughness produced by the process is not isotropic, i.e. its flow varies in and/or across the band's longitudinal direction.

German Offenlegungsschrift No. 2,107,059 describes such a process and states that almost always the aluminum band must be subjected to a cleaning step prior to the brushing step to remove post-rolling residual fats and oils. Also impurities introduced by the roughening step must also be removed by a further special cleaning process.

It is also known in the manufacture of thin aluminum foil of less than 0.05 mm to superimpose two pre-rolled aluminum ribbons and to roll the individual ribbons together and then to separate the thinner foils but the surface roughness resulting therefrom is undesired.

OBJECTS OF THE INVENTION

It is an object of the invention to provide a novel process for the production of aluminum bases for offset printing plates with a uniform surface roughness.

It is a further object of the invention to provide the novel improved aluminum bases for offset printing plates resulting therefrom.

These and other objects and advantages of the invention will become obvious from the following detailed description.

THE INVENTION

The novel process of the invention for the preparation of an aluminum base for offset printing plates comprises superimposing together two prerolled aluminum ribbons with an individual thickness of 0.12 to 0.5 mm, rolling the said superimposed ribbons to an individual ribbion thickness of 0.08 to 0.22 mm whereby the mutual contact surfaces have an uniform surface roughness, separating the two ribbons and forming a stable aluminum oxide layer on the uniformly roughened surfaces.

The resulting bases have one surface with a uniform roughness with a more uniform isotropic surface roughness than the prior art, are produced by a less expensive process than the prior art and usually without any special cleaning steps and at most only one cleaning step.

For best results, the aluminum bands are softened by annealing prior to the superimposing step.

In a preferred modification of the invention, the two superimposed bands are each initially 0.02 to 0.1 mm thick and are rolled to an individual thickness of 0.015 to 0.040 mm to produce a surface roughness on the contact surfaces, separating the rolled-together bands and securing the bands to the surface of a rigid carrier element with the roughened surface exposed and forming a stable aluminum oxide layer either prior to or after the securing step which is preferably effected by oxidation during a storage curing step.

The rigid carrier element may be made of any suitable material but is preferably made of aluminum of greater thickness than the roughened band to be secured thereto. The securing may be effected with any suitable bonding agent but is preferably a two-component bonding agent such as polyurethane resins which are resistant to chemicals used in the chemographic treatment to poduce offset printing plates.

The stable oxide layer may be formed by any suitable means such as by heating the roughened band in the presence of oxygen or by anodization but is preferably allowed to form naturally by storing the aluminum bands in the presence of air for at least three months. Preferably, the aluminum sheets are degreased just prior to us as a base for offset printing plates.

In the following examples there are described several preferred embodiments to illustrate the invention. However, it should be understood that the invention is not intended to be limited to the specific embodiments.

EXAMPLE 1

A band of 99.5% aluminum (DIN 1712 quality) measuring 1100 mm wide and 0.6 mm thick was annealed for 12 hours in air at 450 to 550° C. and was then rolled in a first reduction step at 200 m/min to a thickness of 0.35 mm. The sheet was then rolled in a second reduction step at 180 m/min. to a thickness of 0.20 mm and the band was annealed again at 450° C. for 12 hours. The aluminum band was then doubled over to superimpose one surface on the other and the bands were then rolled at 100 m/min to an individual thickness 0.10 mm.

During the last rolling step, the deformation produced an isotropic, highly uniform surface roughness, probably because of an incompletely homogenous flux in the aluminum microrange on the mutual contact surfaces. The two bands with an individual thickness of 0.1 mm were then separated and cut into smaller pieces of the desired size.

The cut up bands were then stored for a period of at least 3 months during which a stable aluminum oxide layer was formed on the roughened surfaces which could then be used without further treatment as a base for offset printing plates. Any residual fat and/or rolling oil still adhering to the base will not effect their use since the chemographic treatment to produce the offset printing plates neutralizes by saponification the residual oils. However, if necessary, the aluminum bases may be degreased by the usual process such as treatment with an organic solvent like an alcohol.

EXAMPLE 2

An aluminum band with a thickness of 0.6 mm was prepared as in Example 1 and was then soft annealed for 12 hours at 450° to 550° C. and was then rolled in 4 individual reduction steps: the first reduction was at a rolling speed of 250 m/min to obtain a thickness of 0.33 m; the second reduction was at a rolling speed of 180 m/min to a thickness of 0.18 mm; the third reduction was at 300 m/min; and the fourth reduction was at 400 m/min to a final thickness of 0.04 mm. The resulting band was then doubled over and was reduced at a rolling speed of 250 m/min to obtain an individual band thickness of 0.02 mm. The doubled bands were separated and the roughened surface was allowed to oxidize by storage for at least 3 months.

An aluminum band to serve as a carrier or support element was reduced in a single step reduction to a thickness of 0.08 mm and the above oxidized band was laminated thereon in a continuous laminating machine with a 2-component bonding agent, preferably, Pentacoll ET 691 and/or ET 691C (a polyurethane adhesive resistant to chemicals used in production of offset printing plates) to obtain a two-layer base with a thickness of 0.1 mm. The base was sufficient molt stability and may be cut into the desired shape and size for offset printing plates. If necessary, the base may be subjected to a degreasing step.

Various modifications of the products and process of the invention may be made without departing from the spirit or scope thereof and it is to be understood that the invention is intended to be limited only as defined in the appended claims.

We claim:

1. A process for the preparation of an aluminum base for offset printing plates comprising superimposing together two prerolled aluminum ribbons with an individual thickness of 0.12 to 0.5 mm, rolling the said superimposed ribbons to an individual ribbon thickness of 0.08 to 0.22 mm whereby the mutual contact surfaces have an uniform surface roughness, separating the two ribbons and forming a stable aluminum oxide layer on the uniformly roughened surfaces.

2. The process of claim 1 wherein the stable oxide layer is formed by aging for at least 3 months.

3. The process of claim 1 wherein the aluminum band is softened by annealing before rolling.

4. The process of claim 1 wherein the oxidized band is degreased prior to use.

5. An aluminum base produced by the process of claim 1.

6. A process for the preparation of an aluminum base for offset printing plates comprising superimposing together two prerolled aluminum ribbons with an individual thickness of 0.02 to 0.1 mm, rolling the said superimposed ribbons to an individual ribbon thickness of 0.015 to 0.04 mm, separating the two ribbons and forming a stable aluminum oxide layer on the roughened surface, the separated ribbons being secured to a stiff carrier element.

7. The process of claim 6 wherein the carrier element is an aluminum band thicker than the roughened aluminum ribbion.

8. The process of claim 6 wherein the aluminum oxide layer is formed by aging for at least 3 months.

* * * * *